United States Patent [19]

Cooper et al.

[11] Patent Number: 4,846,303

[45] Date of Patent: Jul. 11, 1989

[54] TWO-POSITION LADDER

[76] Inventors: Richard F. Cooper, Rte. 1, Box 43, Palmersville, Tenn. 38241; Michael R. Williamson, Rte. 2, Box 251A, Dresden, Tenn. 38225

[21] Appl. No.: 274,470

[22] Filed: Nov. 21, 1988

[51] Int. Cl.[4] ..... B63B 27/14

[52] U.S. Cl. ..... 182/36; 182/91; 182/97; 114/362

[58] Field of Search ..... 182/36, 39, 20, 21, 182/97, 113, 115, 91, 36, 97, 91; 114/362

[56] References Cited

U.S. PATENT DOCUMENTS 2,059,240 11/1936 Johnston ..... 182/20

*Primary Examiner*—Reinaldo P. Machado

*Attorney, Agent, or Firm*—John J. Mulrooney

[57] ABSTRACT

A pipe track has a groove in which a ladder is slidably mounted for movement between ends of the track. A pair of spaced, downwardly extending notches at one end of the groove permit the ladder to be pivoted downwardly to occupy a vertical position coplanar with the track; and a pair of spaced, upwardly extending notches at the other end of the groove permit the ladder to be pivoted upwardly to occupy a vertical position coplanar with the track.

3 Claims, 2 Drawing Sheets

30
32
34
36
39
22
38

44
40
19
12
22
26
24
6
46

18
42
16
10

14
34

TWO-POSITION LADDER

BACKGROUND OF THE INVENTION

This invention relates to ladders, and more particularly to a two-position ladder useful in situations requiring a ladder to be either deployed for use or stored conveniently nearby and ready for use, such as on pontoon-type boats.

The prior art marine ladders known to the inventors are unsatisfactory for several reasons. Some marine ladders comprise a ladder permanently attached to the side of the boat. Such a permanent ladder is a danger to swimmers when the boat is moving and causes a drag on the boat's motion. Another commonly used marine ladder comprises a ladder which is removably positioned at the side of the boat when in use and, when not in use, is removed and stored on the boat deck. Such a removable ladder is unsatisfactory because it poses a safety hazard while lying on the deck and, more importantly, it can not be reached and deployed by someone in an emergency situation in the water needing to get into the boat. The prior art does not provide for a permanently attached marine ladder which has a self-storing feature, which is out of the way when not in use, and which is deployable from its stored position to a usable position by persons either on the boat or in the water.

Therefore, an object of the invention is to provide an improved ladder.

Another object of the invention is to provide an improved two-position ladder.

Another object of the invention is to provide an improved ladder having stored and use positions in an unitary structure.

Another object of the invention is to provide an improved two-position marine ladder.

Another object of the invention is to provide a marine ladder permanently mounted on the boat and which is movable from a stored position to a use position.

Another object of the invention is to provide a marine ladder having use and stored positions and which may be moved between the stored and use positions by persons either on the boat or in the water.

SUMMARY OF THE INVENTION

The ladder of the present invention comprises a grooved, pipe track and a ladder which is slidably and pivotably mounted in said grooved track whereby the ladder is capable of sliding along said grooved track from end to end. At one end of the groove, a pair of downwardly extending notches enable the ladder to pivot downwardly to a vertical position coplanar with the track; and at the other end of said track a pair of notches extend upwardly from said groove whereby the ladder is capable of pivoting upwardly from said groove to a stored vertical position coplanar with said track.

DESCRIPTION OF THE PREFERRED EMBODIMENTS

Figure 1:
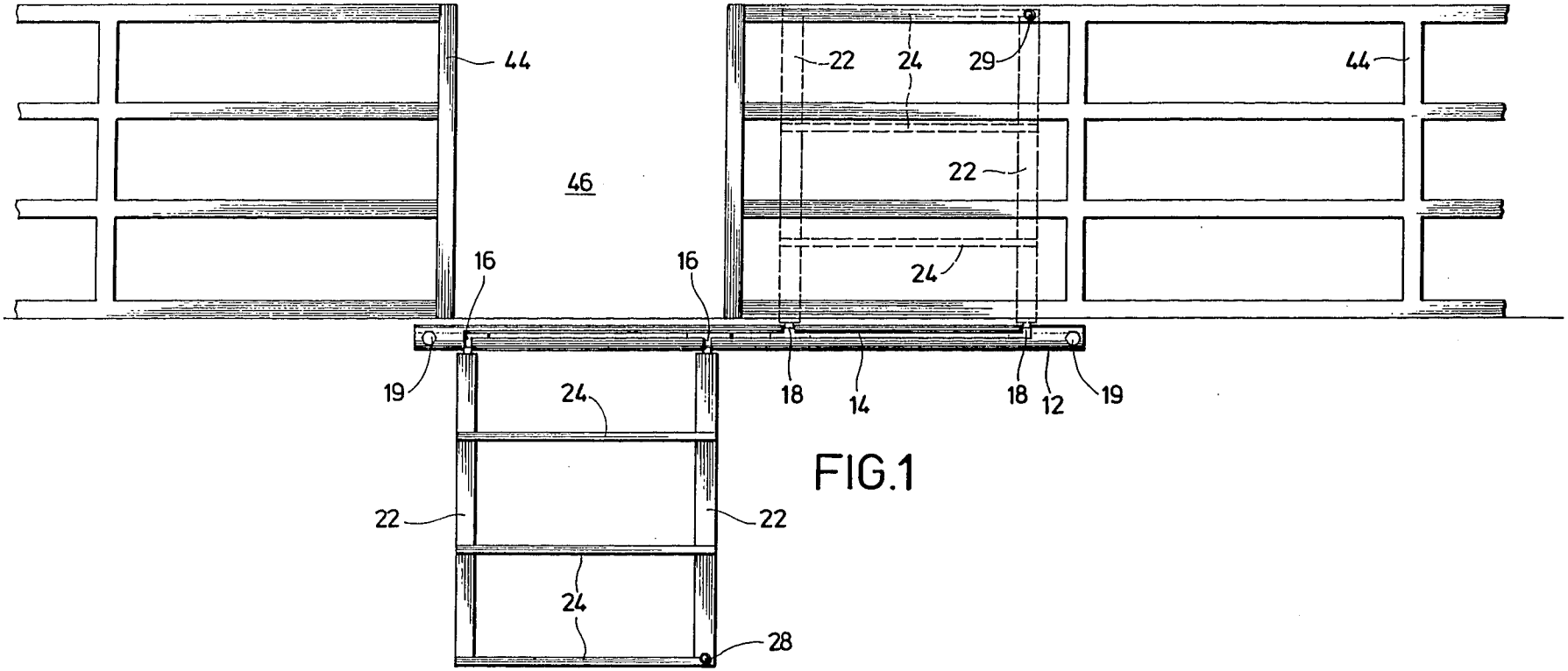
FIG. 1 is a front elevation view showing the grooved pipe track and the ladder deployed in the down or use position, with the alternative position of the ladder in the up, stored position being shown in hidden line format.
Figure 3:
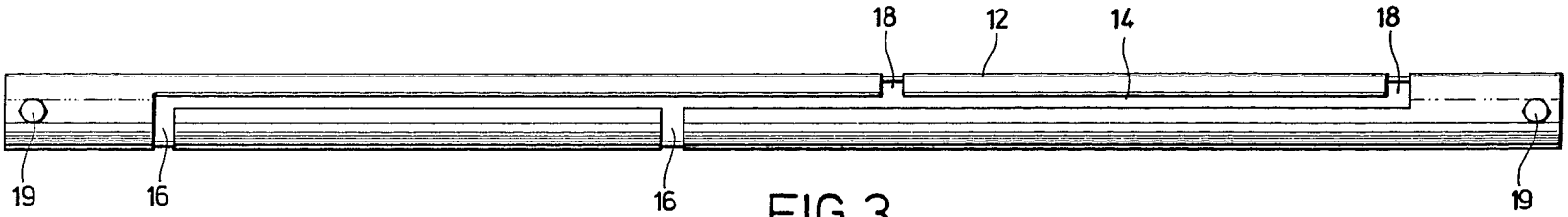
FIG. 3 is an elevation view of the grooved pipe track.

Referring to the drawings, the two-position ladder of the present invention is generally designated by the reference numeral 10. The ladder comprises a pipe track 12 having a groove 14 extending substantially the length thereof. The groove has at one end a first pair of slots or notches 16 which extend downwardly therefrom. At the opposite end of track 12, a second pair of slots or notches 18 extend upwardly from the groove. Bolts 19 permit the track to be mounted on a boat or other structure. While the pipe track 12 is shown as a one-piece design, the track 12 may comprise a two-piece construction. The inventors' experience is that either construction functions satisfactorily.

A ladder comprises a pair of two relatively long sidepieces 22 joined at intervals by crosspieces 24. Bumper blocks 26 of rubber or other suitable material are positioned on the back side of each sidepiece 22 and function to contact the boat side or pontoon, or other structure present where the ladder is used.

A sliding pin mounting block assembly generally indicated by numeral 30 (FIG. 4) positioned at the top end of each sidepiece 22 (FIG. 6) slidably and pivotably attaches the ladder to the pipe track 12. The sliding pin assembly comprises a pin 32 positioned in the groove 14. A bolt 34, or other suitable securing means, attaches the sliding pin 32 to pin mounting block 36. The pin mounting blocks 36 are designed to fit within the upper ends of the ladder sidepieces 22, and bolts 38, or other suitable securing means, attach the sliding pin mounting block assemblies 30 to the ladder sidepieces 22.

All parts of the grooved pipe track, the ladder and the sliding pin mounting block assembly are constructed of aluminum, or some other suitable material having the required characteristics of strength, resistance to corrosion and appearance.

Figures 2, 4, 5, 6:
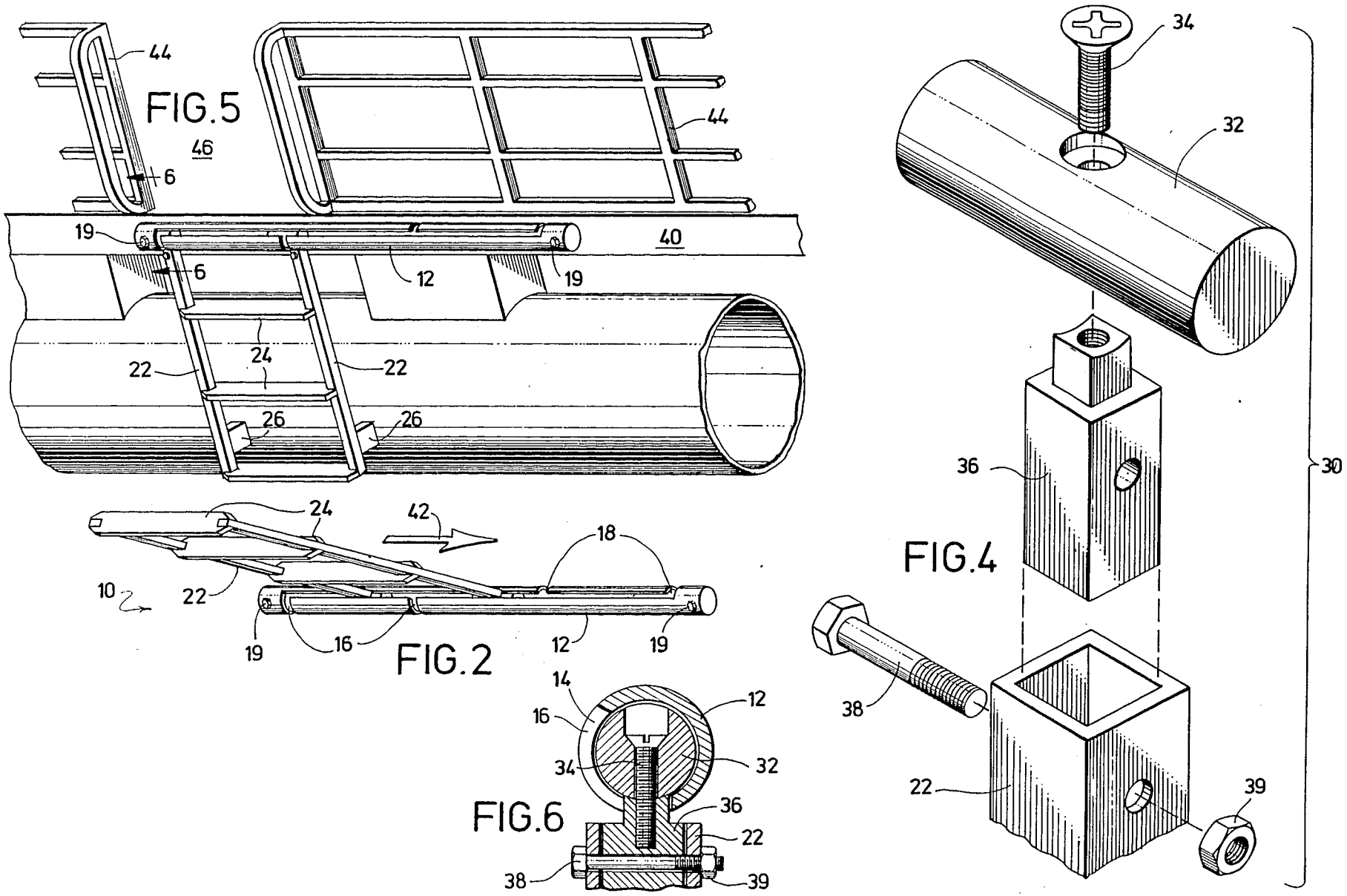
FIG. 2 is a perspective view of the track and ladder showing the ladder pivoted for sliding in the groove between ends of the track.
FIG. 4 is a view partially broken away of the sliding pin mounting block assembly which slidably and pivotably connects the ladder to the pipe track.
FIG. 5 is a perspective view partially broken away showing the ladder of the present invention mounted on a pontoon-type boat and deployed in the use position.
FIG. 6 is a sectional view taken along lines 6—6 in FIG. 5.

Referring now to FIG. 5, the two-position ladder of the present invention is shown on a pontoon-type boat indicated generally by the reference number 40 and having a deck, a handrail 44 extending upwardly from the deck, a gate 46 and a pontoon. The pipe track 12 may be bolted or attached by other means directly to the boat side; or, if necessary, the pipe track may be mounted on a bracket (not shown) which is attached to the boat side as will be recognized by those skilled in the art. The track 12 is positioned along the side of boat 40 so that the downwardly extending notches 16 are aligned with the gate 46. When it is desired to deploy the ladder from the up or stored position to the down, usable position, the ladder is pivoted downwardly in notches 18 until the sliding pin mounting blocks 36 are aligned with groove 14 (FIG. 2). The ladder can then be slid to a position in front of gate 46 where the sliding pin mounting blocks 36 will align with the downwardly extending notches 16. The ladder may then be pivoted downwardly until it is in a vertical plane with pipe track 12 and engaging the water below, and the bumper blocks 26 are contacting the pontoon. The process is reversed to move the ladder from the down position to the up, stored position: the ladder is pivoted upwardly, slid along groove 14 as indicated by arrow 42 (FIG. 2) to notches 18, and pivoted upwardly to a vertical position. Fastener means shown at 28, 29 (FIG. 1) such as a clip, latch or snap may be used to secure the ladder in the up, stored position.

The ladder of the present invention may be used as a gangplank by pivoting the ladder to a horizontal position and resting the free end thereof on a dock or other structure.

It can be seen that a novel, two-position ladder has been provided, which combines convenience to use with safety, and which has a self-storage feature. The present invention avoids the prior art problems of the permanently affixed ladder, or the movable ladder which was stored on the boat deck and created a safety hazard.

While the invention has been disclosed as being useful as a marine ladder, it will be apparent that the invention is equally useful in other environments such as on motor vehicles, or loading docks, or wherever a two position ladder is needed.

What is claimed is:

1. A two-position ladder comprising:

a pipe track having a groove therein extending substantially from one end thereof to the other end thereof, said groove having a pair of spaced downwardly extending notches at one end thereof and a pair of spaced upwardly extending notches at the other end thereof;

a ladder;

means for slidably and pivotably mounting said ladder on said track whereby said ladder is capable of pivoting and sliding within and along said track from a storage position to a use position.

2. A two-position ladder comprising:

a pipe track having a groove therein extending substantially from one end thereof to the other end thereof, said groove having a pair of spaced downwardly extending notches at one end thereof and a pair of spaced upwardly extending notches at the other end thereof;

a ladder;

means for slidably and pivotably mounting said ladder on said track, whereby said ladder may be slid from one end of said track to the other end thereof, and pivoted in said downwardly extending notches to a vertical position below and coplanar with said pipe track, and may be pivoted in said upwardly extending notches to a vertical position above and coplanar with said pipe track.

3. A ladder useful in combination with a boat having a deck, a guardrail extending upwardly from said deck and a gate in said guardrail, said ladder comprising:

a pipe track mounted on the side of said boat, whereby part of said track is positioned below said gate, and said track having a groove extending substantially the length of said track, said track part horizontally adjacent to said gate having a pair of spaced upwardly extending notches in said groove whereby said ladder may be pivoted upwardly, and said track part position below said gate having a pair of spaced downwardly extending notches whereby said ladder may be pivoted downwardly;

a ladder; and mounting means for slidably and pivotably mounting said ladder on said pipe track whereby said ladder may be pivoted and slid from a stored position horizontally adjacent to said gate to a use position aligned with and below said gate.

* * * * *